US011776472B2

(12) United States Patent
Song et al.

(10) Patent No.: US 11,776,472 B2
(45) Date of Patent: Oct. 3, 2023

(54) DISPLAY DEVICE AND METHOD FOR DRIVING THEREOF

(71) Applicant: Samsung Display Co., Ltd., Yongin-Si (KR)

(72) Inventors: A Ree Song, Seoul (KR); Eun Jung Lee, Yongin-si (KR); Woo-Young Cheon, Suwon-si (KR); Byeong Hwa Choi, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/187,119

(22) Filed: Feb. 26, 2021

(65) Prior Publication Data

US 2022/0051620 A1 Feb. 17, 2022

(30) Foreign Application Priority Data

Aug. 12, 2020 (KR) ..... 10-2020-0101085

(51) Int. Cl.
*G09G 3/3233* (2016.01)

(52) U.S. Cl.
CPC ... *G09G 3/3233* (2013.01); *G09G 2320/0247* (2013.01); *G09G 2320/0261* (2013.01); *G09G 2320/064* (2013.01); *G09G 2320/10* (2013.01)

(58) Field of Classification Search
CPC ..... G09G 3/3233; G09G 2320/0247; G09G 2320/0261; G09G 2320/064; G09G 2320/10; G09G 3/3208; G09G 3/3275; G09G 3/3283; G09G 3/3291
See application file for complete search history.

(56) References Cited

U.S. PATENT DOCUMENTS

| | | | | |
|---|---|---|---|---|
| 2017/0018234 | A1* | 1/2017 | Na | G09G 3/3406 |
| 2019/0347995 | A1* | 11/2019 | Hasegawa | G09G 3/3233 |
| 2020/0082768 | A1* | 3/2020 | Oh | G09G 3/3291 |
| 2021/0183290 | A1* | 6/2021 | Sato | G09G 3/3233 |

FOREIGN PATENT DOCUMENTS

| | | | |
|---|---|---|---|
| KR | 10-0857672 | B1 | 9/2008 |
| KR | 10-2015-0057547 | A | 5/2015 |
| KR | 10-2015-0094881 | A | 8/2015 |
| KR | 10-2017-0010175 | A | 1/2017 |
| KR | 10-2019-0024548 | A | 3/2019 |

* cited by examiner

*Primary Examiner* — Dennis P Joseph
(74) *Attorney, Agent, or Firm* — Innovation Counsel LLP

(57) ABSTRACT

The present disclosure relates to a display device and a driving method thereof, and the display device according to an example embodiment includes a pixel unit including a plurality of pixels, and a light emission driver outputting a light emission control signal having different light emission cycles according to a driving frequency and a required luminance to the pixel unit.

14 Claims, 10 Drawing Sheets

DISPLAY DEVICE AND METHOD FOR DRIVING THEREOF

CROSS-REFERENCE TO RELATED APPLICATION

This application claims priority to and the benefit of Korean Patent Application No. 10-2020-0101085 filed in the Korean Intellectual Property Office on Aug. 12, 2020, the entire contents of which are incorporated herein by reference.

BACKGROUND

1. Field

The present disclosure relates to a display device and a driving method thereof. More particularly, the present disclosure relates to a display device capable of preventing a stepped blur and an increase in the driving voltage, and a driving method thereof.

2. Description of the Related Art

An organic light emitting diode (OLED) display includes two electrodes and an organic emission layer interposed therebetween. Electrons injected from one electrode and holes injected from the other electrode are combined in the organic emission layer to generate excitations. The generated excitations are changed to a ground state from an excited state, releasing energy to emit light.

These organic light emitting devices are in the spotlight as next-generation displays because they have a fast response speed and are driven with low power consumption at the same time.

In such an organic light emitting device, it is not easy to precisely control the driving current in a driving period expressing low luminance, so a method of driving by adjusting a duty ratio of an emission control signal has been proposed. At this time, as a width of an off period increases, a black driving time increases, so that a cycle of the light emission control signal may be driven to be increased to solve a problem that flicker is recognized.

However, if the cycle of the signal is increased, a stepped blur appears in a motion picture, and there is a problem that the driving voltage increases.

The above information disclosed in this Background section is only for enhancement of understanding of the background of the described technology, and therefore it may contain information that does not form the prior art that is already known in this country to a person of ordinary skill in the art.

SUMMARY

An example embodiment is to provide a display device capable of preventing a stepped blur and an increase in the driving voltage, and a driving method thereof.

A display device according to an example embodiment includes a pixel unit including a plurality of pixels, and a light emission driver outputting a light emission control signal having different light emission cycles according to a driving frequency and a required luminance to the pixel unit.

The display device according to an example embodiment may further include a light emission cycle controller receiving the driving frequency and the required luminance to determine the light emission cycle to be output to the light emission driver.

The light emission cycle controller may include a driving frequency receiving unit receiving the driving frequency, a required luminance receiving unit receiving the required luminance; a duty ratio determining unit determining an off duty ratio of the light emission control signal, and a light emission cycle determining unit determining the light emission cycle.

The duty ratio determining unit may set the off duty ratio higher as the required luminance is lower.

The light emission cycle determining unit may determine the light emission cycle from the driving frequency, the required luminance, and the off duty ratio.

The light emission cycle determining unit may derive the light emission cycle by using a look-up table, and the look-up table may store information for a minimum light emission cycle such that a flicker is not visually recognized according to the driving frequency, the required luminance, and the off duty ratio.

When the driving frequency is 100 Hz or more, there may be one light emission cycle.

When the driving frequency is 90 Hz, if the required luminance is less than 150 nits, there may be one light emission cycle, and if the required luminance is 150 nits or more, there may be more than one light emission cycle.

When the driving frequency is 90 Hz and the required luminance is 400 nits or more, if the off duty ratio is 50% or less, there may be one light emission cycle, and if the off duty ratio is more than 50%, there may be six light emission cycles.

The pixel unit may include a plurality of scan lines, a plurality of data lines, and a plurality of light emission control lines connected to each of the plurality of pixels, and the light emission control line may transmit the light emission control signal from the light emission driver to the pixel unit.

A driving method of a display device according to an example embodiment includes receiving a driving frequency of a display device, receiving a required luminance representing a brightness of a screen of the display device, and determining a light emission cycle of a light emission control signal output to the pixel unit according to the driving frequency and the required luminance.

The driving method of the display device according to an example embodiment may further include determining an off duty ratio of the light emission control signal according to the required luminance.

In the determining of the off duty ratio, the lower the required luminance is, the higher the off duty ratio may be.

In the determining of the light emission cycle of the light emission control signal, the light emission cycle may be determined according to the driving frequency, the required luminance, and the off duty ratio.

The determining of the light emission cycle of the light emission control signal may include comparing the driving frequency with a reference frequency, comparing the required luminance with the reference luminance; and determining the light emission cycle.

When the driving frequency is compared with the reference frequency and the driving frequency is the reference frequency or more, there may be one light emission cycle.

The reference frequency may be 100 Hz.

When the required luminance is compared with the reference luminance and the required luminance is less than the reference luminance, there may be one light emission cycle.

The reference luminance may have different values according to the driving frequency.

When the required luminance is compared with the reference luminance and the required luminance is the reference luminance or more, the light emission cycle may be determined with reference to a look-up table, and the look-up table may store information for a minimum light emission cycle in which a flicker is not visually recognized according to the driving frequency, the required luminance, and the off duty ratio.

According to an example embodiment, when the flicker is not visually recognized, the number of cycles of the signal is not increased, thereby preventing a stepped blur and an increase in the driving voltage.

DETAILED DESCRIPTION

Figure 1:
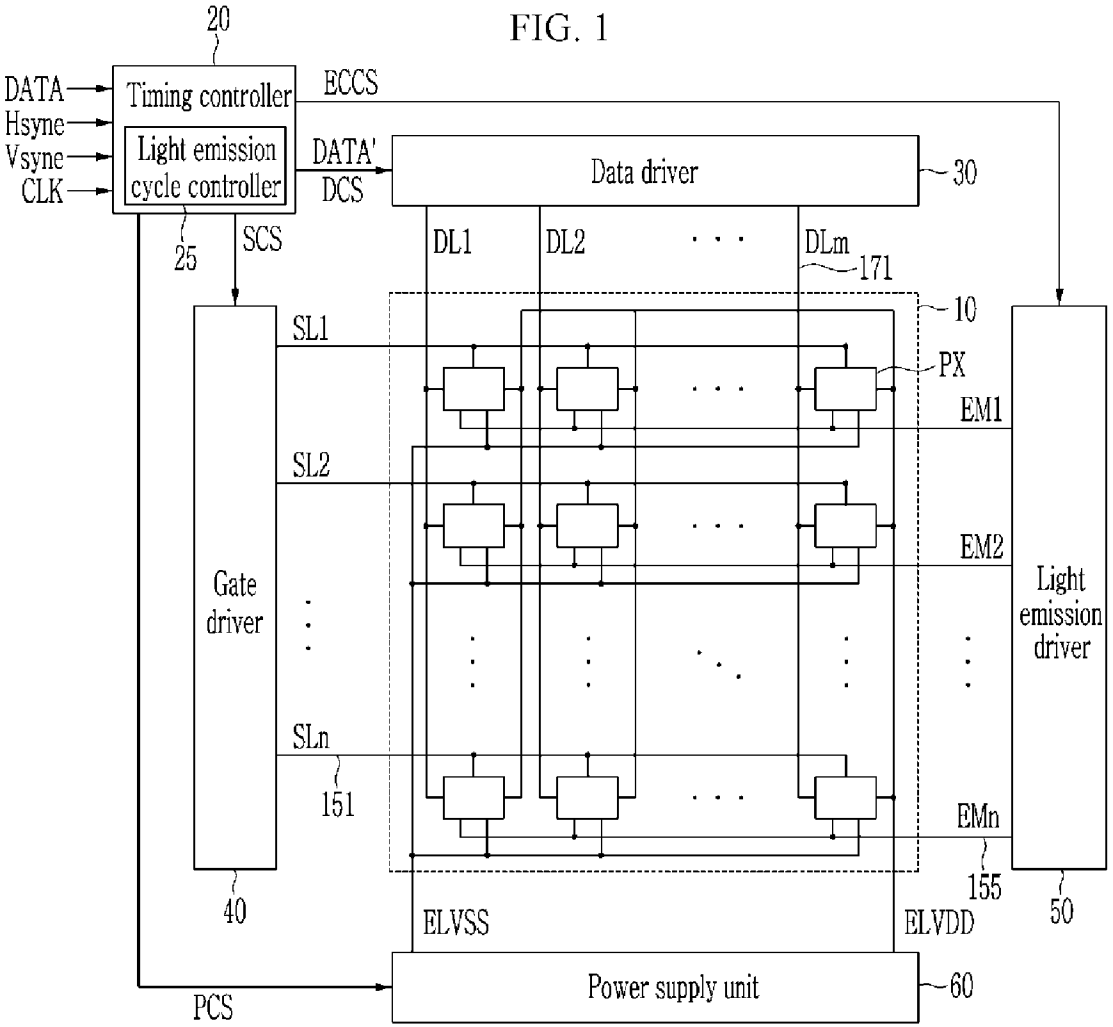
FIG. 1 is a schematic block diagram showing a display device according to an example embodiment.

The present disclosure will be described more fully hereinafter with reference to the accompanying drawings, in which example embodiments of the disclosure are shown. As those skilled in the art would realize, the described embodiments may be modified in various different ways, all without departing from the spirit or scope of the present disclosure.

In order to clearly explain the present disclosure, a portion that is not directly related to the present disclosure was omitted, and the same reference numerals are attached to the same or similar constituent elements through the entire specification.

In addition, the size and thickness of each configuration shown in the drawings are arbitrarily shown for better understanding and ease of description, but the present disclosure is not limited thereto. In the drawings, the thickness of layers, films, panels, regions, etc., are exaggerated for clarity. In the drawings, for better understanding and ease of description, the thicknesses of some layers and areas are exaggerated.

It will be understood that when an element such as a layer, film, region, or substrate is referred to as being "on" another element, it can be directly on the other element or intervening elements may also be present. In contrast, when an element is referred to as being "directly on" another element, there are no intervening elements present. Further, in the specification, the word "on" or "above" means positioned on or below the object portion, and does not necessarily mean positioned on the upper side of the object portion based on a gravitational direction.

In addition, unless explicitly described to the contrary, the word "comprise", and variations such as "comprises" or "comprising", will be understood to imply the inclusion of stated elements but not the exclusion of any other elements.

Further, in the specification, the phrase "on a plane" means viewing the object portion from the top, and the phrase "on a cross-section" means viewing a cross-section of which the object portion is vertically cut from the side.

First, a display device according to an example embodiment is described with reference to FIG. 1.

FIG. 1 is a schematic block diagram showing a display device according to an example embodiment.

As shown in FIG. 1, the display device according to an example embodiment may include a pixel unit 10, a timing controller 20, a data driver 30, a gate driver 40, a light emission driver 50, and a power supply unit 60.

The pixel unit 10 includes a plurality of scan lines 151 transmitting scan signals SL1 to SLn and a plurality of light emission control lines 155 transmitting light emission control signals EM1 to EMn, which extend in a first direction, a plurality of data lines 171 extending in a second direction crossing the first direction and transmitting data voltages DL1 to DLm, and a plurality of pixels PX connected to the plurality of signal lines and arranged in a matrix form. Each pixel PX receives the scan signals SL1 to SLn and the data voltages DL1 to DLm from the scan lines 151 and the data lines 171, respectively. The light emission control signals EM1 to EMn are supplied from the light emission control lines 155. Each pixel PX is emitted corresponding to the scan signals SL1 to SLn, the data voltages DL1 to DLm, the light emission control signals EM1 to EMn, a driving voltage ELVDD, and a common voltage ELVSS, thereby displaying an image. For each pixel PX, a light emission time may be adjusted in response to the light emission control signals EM1 to EMn.

The timing controller 20 receives first image data DATA and input control signals to control display thereof from an external image source, for example, a horizontal synchronizing signal Hsync, a vertical synchronization signal Vsync, and a clock signal CLK. The timing controller 20 may image-process the input first image data DATA to generate a second image data DATA' that is corrected to be suitable for the image display of the pixel unit 10 and provide the generated second image data DATA' to the data driver 30. In addition, the timing controller 20 generates and outputs driving control signals DCS, SCS, EDCS, and PCS that control the driving of the data driver 30, the gate driver 40, the light emission driver 50, and the power supply unit 60 based on the input control signals.

On the other hand, the timing controller 20 may include a light emission cycle controller 25 for adjusting an on/off duty ratio and a light emission cycle of the light emission control signals EM1 to EMn. The light emission cycle controller 25 may determine the on/off duty ratio of the light emission control signals EM1 to EMn depending on a required luminance and adjust the light emission cycle from a driving frequency, the required luminance, and the on/off duty ratio of the light emission control signals EM1 to EMn. For example, when the required luminance is high, the off duty ratio may be set relatively low. In addition, the lower the driving frequency, the lower the required luminance, and the higher the off duty ratio, the greater the light emission cycle may be adjusted. The detailed information for this is described further in the following description after FIG. 3.

The data driver 30 is connected to the plurality of data lines 171, and generates the data voltages DL1 to DLm in response to a data control signal DCS of the timing controller 20 and outputs the generated data voltages DL1 to DLm to the data lines 171. At this time, the data driver 30 converts the digital second image data DATA' provided from the timing controller 20 into analog type data voltages DL1 to DLm and outputs them to the data lines 171. The data voltages DL1 to DLm are generated based on a gamma reference voltage, and the data driver 30 may receive the gamma reference voltage from a gamma reference voltage generator (not shown). The data driver 30 sequentially transmits the data voltages DL1 to DLm to each of a plurality of pixels included in a predetermined row among the pixels PX of the pixel unit 10.

The gate driver 40 is connected to a plurality of scan lines 151, generates the scan signals SL1 to SLn in response to a scan control signal SCS of the timing controller 20, and outputs the generated scan signals SL1 to SLn to the scan lines 151. The data voltages DL1 to DLm may be provided by sequentially selecting the pixels PX for each row according to the scan signals SL1 to SLn. The gate driver 40 may supply the scan signals SL1 to SLn according to a predetermined driving frequency, and the driving frequency may be controlled by the timing controller 20.

The light emission driver 50 is connected to a plurality of light emission control lines 155, generates the light emission control signals EM1 to EMn by a light emission cycle control signal ECCS of the timing controller 20, and transmits them to each of the light emission control lines 155. At this time, in response to the light emission cycle control signal ECCS, the on/off duty ratio and the light emission cycle of the light emission control signals EM1 to EMn are adjusted. That is, according to the light emission control signals EM1 to EMn, the light emission time of the pixels PX and the number of light emissions in one frame may be adjusted.

The power supply unit 60 may apply a high-potential driving voltage ELVDD and a low-potential common voltage ELVSS to the pixel unit 10 according to the power control signal PCS. The power supply unit 60 may include a DC-DC converter (not shown) for generating the driving voltage ELVDD and the common voltage ELVSS. Each of the pixels PX supplied with the driving voltage ELVDD and the common voltage ELVSS from the power supply unit 60 may emit light corresponding to the data voltage by the current flowing from the driving voltage ELVDD to the common voltage ELVSS via the organic light emitting element.

Next, one pixel of the display device according to an example embodiment is described with reference to FIG. 2.

Figure 2:
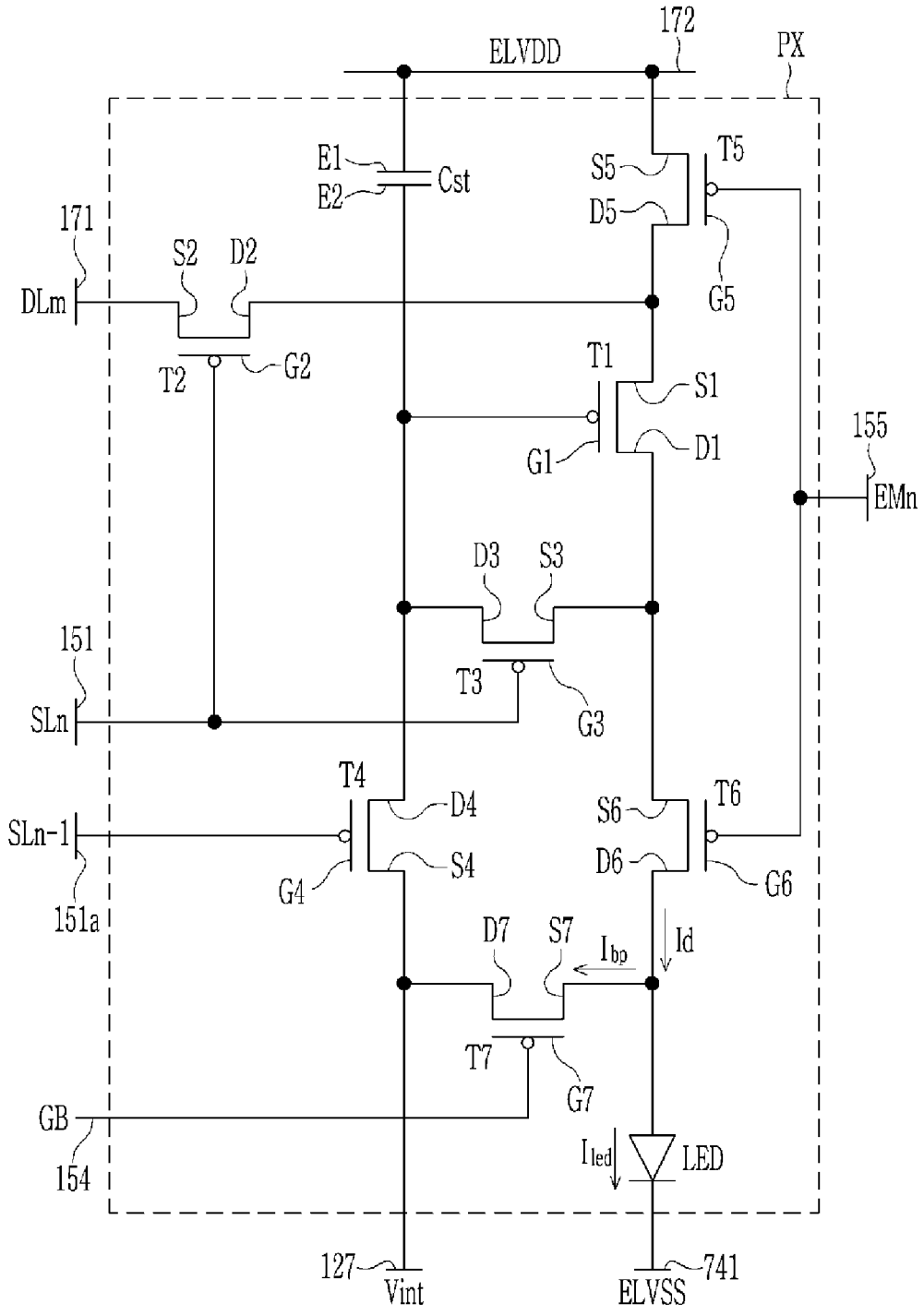
FIG. 2 is a circuit diagram of one pixel of a display device according to an example embodiment.

FIG. 2 is a circuit diagram of one pixel of a display device according to an example embodiment.

As shown in FIG. 2, one pixel PX of the display device according to an example embodiment includes a plurality of transistors T1, T2, T3, T4, T5, T6, and T7 connected to the different signal lines, a storage capacitor Cst, and a light emitting diode LED.

The display device according to an example embodiment includes a display area in which an image is displayed, and these pixels PX are arranged in various shapes in the display area.

The plurality of transistors T1, T2, T3, T4, T5, T6, and T7 include a driving transistor T1 and a switching transistor connected to the scan lines 151, that is, a second transistor T2 and a third transistor T3, and other transistors (hereinafter referred to as compensation transistors) are for an operation required to operate the light emitting diode (LED) LED. These compensation transistors T4, T5, T6, and T7 may include a fourth transistor T4, a fifth transistor T5, a sixth transistor T6, and a seventh transistor T7.

A plurality of signal lines may include a scan line 151, a previous scan line 151*a*, a light emission control line 155, a bypass control line 154, a data line 171, a driving voltage line 172, an initialization voltage line 127, and a common voltage line 741. The bypass control line 154 may be a part of the previous scan line 151*a* or may be electrically connected thereto. Also, the bypass control line 154 may be a part of the scan line 151 or may be electrically connected thereto.

The scan line 151 is connected to the gate driver to transmit a scan signal SLn to the second transistor T2 and the third transistor T3. The previous scan line 151*a* is connected to the gate driver to transmit the previous scan signal SL(n−1) applied to the pixel PX disposed at the previous stage to the fourth transistor T4. The light emission control line 155 is connected to the light emission driver and transmits the light emission control signal EMn controlling a time that the light emitting diode (LED) LED emits light to the fifth transistor T5 and the sixth transistor T6. The bypass control line 154 transmits a bypass signal to the seventh transistor T7.

The data line 171 transmits the data voltage generated by the data driver and the luminance of the light emitting diode (LED) LED changes according to the data voltage. The driving voltage line 172 applies the driving voltage. The initialization voltage line 127 transmits an initialization voltage for initializing the driving transistor T1. The common voltage line 741 applies the common voltage. The voltages applied to the driving voltage line 172, the initialization voltage line 127, and the common voltage line 741 may be constant voltages, respectively.

Hereinafter, a plurality of transistors are described.

The driving transistor T1 is a transistor for adjusting a magnitude of the output current depending on the applied data voltage. The output driving current Id is applied to the light emitting diode (LED) LED so that brightness of the light emitting diode (LED) LED is adjusted according to the data voltage. For this purpose, the first electrode S1 of the driving transistor T1 is disposed to receive the driving voltage. The first electrode S1 is connected to the driving voltage line 172 via the fifth transistor T5. The first electrode S1 of the driving transistor T1 is also connected to the second electrode D2 of the second transistor T2 to also receive the data voltage. The second electrode D1 (an output electrode) of the driving transistor T1 outputs the current toward the light emitting diode (LED) LED. The second electrode D1 of the driving transistor T1 is connected to the anode of the light emitting diode (LED) LED via the sixth transistor T6. On the other hand, the gate electrode G1 is connected to one electrode (a second storage electrode E2) of the storage capacitor Cst. Therefore, the voltage of the gate electrode G1 changes according to the voltage stored in the storage capacitor Cst, and the driving current Id output from the driving transistor T1 changes accordingly.

The second transistor T2 receives the data voltage into the pixel PX. The gate electrode G2 is connected to the scan line 151 and the first electrode S2 is connected to the data line 171. The second electrode D2 of the second transistor T2 is connected to the first electrode S1 of the driving transistor T1. When the second transistor T2 is turned on according to the scan signal SLn transmitted through the scan line 151, the data voltage transmitted through the data line 171 is transmitted to the first electrode S1 of the driving transistor T1.

The third transistor T3 allows a compensation voltage of which the data voltage is changed through the driving transistor T1 to be transferred to the second storage electrode E2 of the storage capacitor Cst. The gate electrode G3 is connected to the scan line 151, and the first electrode S3 is connected to the second electrode D1 of the driving transistor T1. The second electrode D3 of the third transistor T3 is connected to the second storage electrode E2 of the storage capacitor Cst and the gate electrode G1 of the driving transistor T1. The third transistor T3 is turned on according to the scan signal SLn received through the scan line 151 to connect the gate electrode G1 and the second electrode D1 of the driving transistor T1 and to also connect the second electrode D1 of the driving transistor T1 and the second storage electrode E2 of the storage capacitor Cst.

The fourth transistor T4 serves to initialize the gate electrode G1 of the driving transistor T1 and the second storage electrode E2 of the storage capacitor Cst. The gate electrode G4 is connected to the previous scan line 151*a*, and the first electrode S4 is connected to the initialization voltage line 127. The second electrode D4 of the fourth transistor T4 is connected to the second storage electrode E2 of the storage capacitor Cst and the gate electrode G1 of the driving transistor T1 via the second electrode D3 of the third transistor T3. The fourth transistor T4 transmits the initialization voltage to the gate electrode G1 of the driving transistor T1 and the second storage electrode E2 of the storage capacitor Cst according to the previous scan signal SL(n−1) received through the previous scan line 151*a*. Accordingly, the gate voltage of the gate electrode G1 of the driving transistor T1 and the storage capacitor Cst are initialized. The initialization voltage may have a low voltage value and may be a voltage capable of turning on the driving transistor T1.

The fifth transistor T5 serves to transmit the driving voltage to the driving transistor T1. The gate electrode G5 is connected to the light emission control line 155, and the first electrode S5 is connected to the driving voltage line 172. The second electrode D5 of the fifth transistor T5 is connected to the first electrode S1 of the driving transistor T1.

The sixth transistor T6 serves to transmit the driving current Id output from the driving transistor T1 to the light emitting diode (LED) LED. The gate electrode G6 is connected to the light emission control line 155 and the first electrode S6 is connected to the second electrode D1 of the driving transistor T1. The second electrode D6 of the sixth transistor T6 is connected to the anode of the light emitting diode (LED) LED.

The fifth transistor T5 and the sixth transistor T6 are simultaneously turned on according to the light emission control signal EMn transmitted through the light emission control line 155, and if the driving voltage is applied to the first electrode S1 of the driving transistor T1 through the fifth transistor T5, the driving transistor T1 outputs the driving current Id according to the voltage of the gate electrode G1 of the driving transistor T1 (i.e., the voltage of the second storage electrode E2 of the storage capacitor Cst). The output driving current Id is transmitted to the light emitting diode (LED) LED through the sixth transistor T6. The light emitting diode (LED) LED emits light while the current $I_{led}$ flows to the light emitting diode (LED) LED.

The seventh transistor T7 serves to initialize the anode of the light emitting diode (LED) LED. The gate electrode G7 is connected to the bypass control line 154, the first electrode S7 is connected to the anode of the light emitting diode (LED) LED, and the second electrode D7 is connected to the initialization voltage line 127. In an embodiment, the bypass control line 154 may be connected to the previous scan line 151*a*, and the bypass signal may be applied with the same timing as the previous scan signal SL(n−1). However, in another embodiment, the bypass control line 154 is not connected to the previous scan line 151*a* and may transmit a separate signal from the previous scan signal SL(n−1). When the seventh transistor T7 is turned on according to the bypass signal GB, the initialization voltage is applied to the anode of the light emitting diode (LED) LED to be initialized.

The first storage electrode E1 of the storage capacitor Cst is connected to the driving voltage line 172, and the second storage electrode E2 is connected to the gate electrode G1 of the driving transistor T1, the second electrode D3 of the third transistor T3, and the second electrode D4 of the fourth transistor T4. Consequently, the second storage electrode E2 determines the voltage of the gate electrode G1 of the driving transistor T1, and the data voltage is applied through the second electrode D3 of the third transistor T3, or the initialization voltage is applied through the second electrode D4 of the fourth transistor T4.

On the other hand, the anode of the light emitting diode (LED) LED is connected to the second electrode D6 of the sixth transistor T6 and the first electrode S7 of the seventh transistor T7, and the cathode is connected to the common voltage line 741 transmitting the common voltage.

Previously, it has been described that one pixel includes seven transistors T1, T2, T3, T4, T5, T6, and T7 and one storage capacitor Cst, but it is not limited thereto, and the number of transistors, the number of capacitors, and their connection relationship may be variously changed.

Next, the light emission cycle controller 25 of the display device according to an example embodiment is further described with reference to FIG. 3 as follows.

Figure 3:
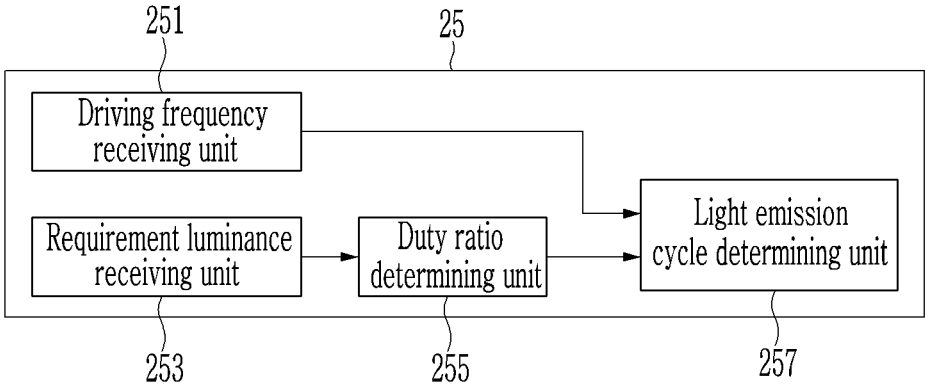
FIG. 3 is a block diagram of a light emission cycle controller of a display device according to an example embodiment.

FIG. 3 is a block diagram showing a light emission cycle controller of a display device according to an example embodiment.

As shown in FIG. 3, the light emission cycle controller 25 of the display device according to an example embodiment may include a driving frequency receiving unit 251 receiving the driving frequency, a required luminance receiving unit 253 receiving the required luminance, a duty ratio determining unit 255 determining the on/off duty ratio of the light emission control signal, and a light emission cycle determining unit 257 determining the light emission cycle.

The driving frequency receiving unit 251 may receive the driving frequency determined in the timing controller 20. The driving frequency is the number of images that may be displayed in one second. In this case, the image refers to an image of one frame, and the driving frequency is also referred to as a frame rate. For example, the display device according to an example embodiment may be driven with a driving frequency of 60 Hz. That is, a motion picture may be expressed by sequentially outputting 60 images per one second. As another example, the display device according to an example embodiment may be driven with a driving frequency of 120 Hz. That is, 120 images may be sequentially output per one second to play moving images. As the driving frequency increases in this way, each movement of moving images may look more smooth and natural to an user, and the driving voltage may increase for faster driving. The driving frequency may be driven in various ways, such as 60 Hz, 90 Hz, 120 Hz, and 240 Hz, as needed. The driving frequency receiving unit 251 may receive information on this driving frequency.

The required luminance receiving unit 253 receives information on the required luminance of a predetermined screen from an external source which is not shown herein. The required luminance as a luminance value representing the brightness of the screen of the display device may mean, for example, a maximum luminance value required to display the screen of one frame. In a dark place, setting the required luminance of the screen low is advantageous in terms of power consumption, and in a bright place, setting the required luminance of the screen high is advantageous in terms of visibility. Accordingly, the user may set the required luminance as needed, and the required luminance receiving unit 253 may receive information about this. For example, the maximum luminance may be set to a level of 400 nits, and the maximum luminance may be set to a level of 50 nits. At this time, the required luminance may be set to be automatically changed even if the user does not set it. For example, by detecting an external light through a separate light sensor, it is possible to automatically increase the required luminance by recognizing it as the bright place when the amount of light to be detected is large. In addition, when the amount of light to be detected is low, the required luminance may be automatically reduced by recognizing it as a dark place.

The duty ratio determining unit 255 may determine the on/off duty ratio of the light emission control signal by receiving the information for the required luminance from the required luminance receiving unit 253. Depending on the light emission control signal, the current $I_{led}$ flows through the light emitting diode (LED) LED to emit light. A section in which light is emitted is called a light emission section, and a length of the light emission section is determined according to the light emission control signal. In this case, a display gray may be controlled by adjusting the on/off duty ratio of the light emission control signal. The display gray may be determined by the total amount of the luminance emitted during the light emission section. When the same data voltage is applied, the higher the on-duty ratio of the light emission control signal is, the longer the length of the light emission section is, and the amount of light emitted during one light emission section increases, so that the display gray may increase. In addition, when the same data voltage is applied, the higher the off duty ratio of the light emission control signal is, the shorter the length of the light emission section is, and the amount of light emitted during one light emission section decreases, so that the display gray may decrease. Therefore, when the required luminance received from the required luminance receiving unit 253 is high, the off duty ratio of the light emission control signal may be set relatively low. In this case, the on duty ratio of the light emission control signal may be set relatively high. In addition, when the required luminance received from the required luminance receiving unit 253 is low, the off duty ratio of the light emission control signal may be set relatively high. In this case, the on duty ratio of the light emission control signal may be set relatively low.

The light emission cycle determining unit 257 may receive the information about the driving frequency from the driving frequency receiving unit 251 and determine the light emission cycle by receiving the information about the required luminance and the off duty ratio of the light emission control signal from the duty ratio determining unit 255. The light emission cycle refers to the number of times that the on/off of the light emission control signal is repeated within one frame.

When the off duty ratio of the light emission control signal is set to be high, the time to be displayed in a black state becomes longer, and the user's eyes perceive a cyclic repetition of the light emission/non-light emission sections, which may appear as a flicker phenomenon. In the display device according to an example embodiment, in order to prevent such a flicker phenomenon from being visually recognized, it may be driven so that the on/off of the light emission control signal is repeated several times within one frame when the flicker is expected. For example, it may be driven so that on/off of the light emission control signal is repeated twice within one frame. Alternatively, it may be driven so that the on/off of the light emission control signal is repeated 4 or 6 times within one frame. In this way, when the on/off of the light emission control signal is repeated several times, a stepped blur phenomenon may appear and the driving voltage may increase. Therefore, in the display device according to an example embodiment, if the flicker is not expected to be recognized, the light emission control signal is driven so that the on/off of the light emission control signal is not repeated within one frame, and if the flicker is expected to be visually recognized, the light emission control signal may be driven so that the on/off of the light emission control signal is repeated at least two or more times. That is, the light emission cycle determining unit 257 may determine whether to repeatedly drive the on/off of the light emission control signal by predicting whether the flicker occurs from information on the driving frequency, the required luminance, and the off duty ratio of the light emission control signal. At this time, the light emission cycle determining unit 257 may include a look-up table (LUT). The look-up table may store information on a minimum light emission cycle in which the flicker is not visually recognized according to the driving frequency, the required luminance, and the off duty ratio of the light emission control signal. The light emission cycle determining unit 257 may use the look-up table from the information on the input driving frequency, the required luminance, and the off duty ratio of the light emission control signal to determine the minimum light emission cycle of the light emission control signal in which the flicker may not occur. Therefore, by selectively controlling the light emission cycle of the light emission control signal without fixing it once or several times, it is possible to prevent the flicker from being generated and to minimize the occurrence of the stepped blur or the increase in the driving voltage.

Hereinafter, various light emission control signals according to the change in the on/off duty ratio and the light emission cycle of the display device according to an example embodiment are described with reference to FIG. 4.

Figure 4:
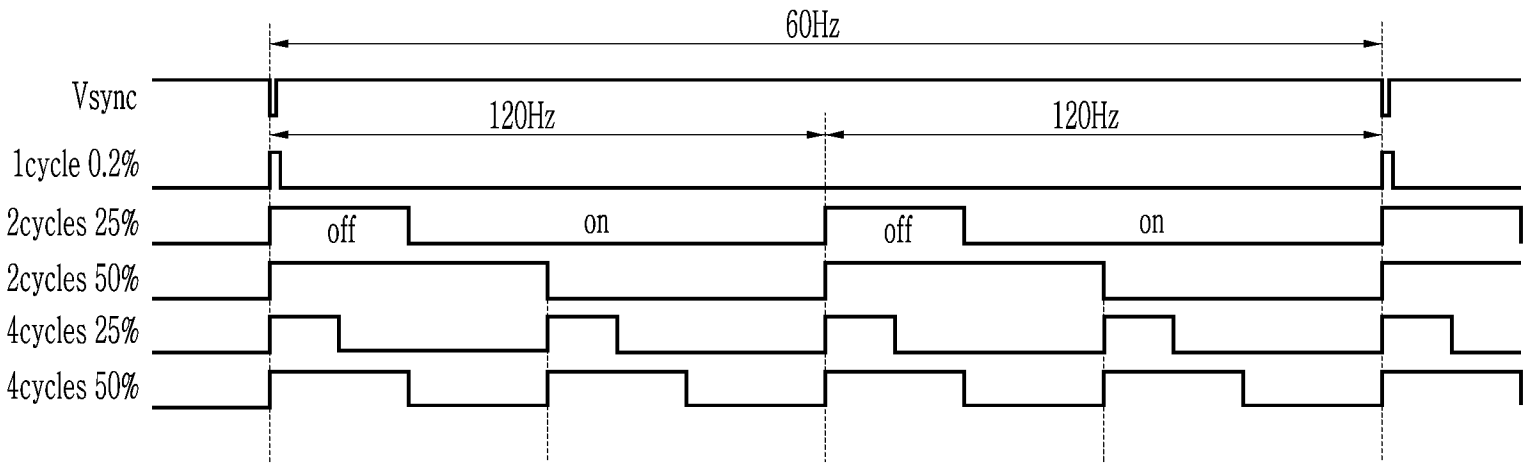
FIG. 4 is a waveform diagram showing various light emission control signals of a display device according to an example embodiment.

FIG. 4 is a waveform diagram illustrating various light emission control signals of the display device according to an example embodiment. The top-positioned waveform is the vertical synchronization signal Vsync, and five light emission control signals are sequentially shown below the vertical synchronization signal Vsync.

As shown in FIG. 4, the display device according to an example embodiment may be driven at 60 Hz. The vertical synchronization signal Vsync is applied and the light emission control signal is applied. At this time, the off voltage of the light emission control signal may be applied first, and the on voltage may then be applied.

In the case of the first light emission control signal (1 cycle, 0.2%), one off voltage and one on voltage are applied within one frame. In this case, the off duty ratio may be about 0.2%, and the on duty ratio may be about 99.8%.

In the case of the second light emission control signal (2 cycles, 25%), two off voltages and two on voltages are applied within one frame. It may be applied in the order of the off voltage-the on voltage-the off voltage-the on voltage. At this time, when considering the entire time when the off voltage is applied, the off duty ratio is about 25%. In addition, when considering the entire time when the on voltage is applied, the on duty ratio is about 75%. In the case of the second light emission control signal (2 cycles, 25%), the off duty ratio is increased and the light emission cycle is increased compared to the first light emission control signal (1 cycle, 0.2%). In the second light emission control signal (2 cycles, 25%), the lower luminance may be expressed by increasing the off duty ratio. In addition, by increasing the light emission cycle, it may be seen that the effect of being driven at 120 Hz appears by substantially making the light emission occur twice within one frame.

In the case of the third light emission control signal (2 cycles, 50%), two off voltages and two on voltages are applied within one frame. It may be applied in the order of the off voltage-the on voltage-the off voltage-the on voltage. In this case, considering the entire time when the off voltage is applied, the off duty ratio is about 50%. In addition, considering the entire time when the on voltage is applied, the on duty ratio is about 50%. In the case of the third light emission control signal (2 cycles, 50%), the off duty ratio increases compared to the second light emission control signal (2 cycles, 25%), and the light emission cycle is maintained. In the third light emission control signal (2 cycles, 50%), the lower luminance can be expressed by increasing the off duty ratio. In addition, it may be seen that the effect of being driven at 120 Hz is achieved by substantially emitting light twice in one frame.

In the case of the fourth light emission control signal (4 cycles, 25%), four off voltages and four on voltages are applied within one frame. It may be applied in the order of the off voltage-the on voltage-the off voltage-the on voltage-the off voltage-the on voltage-the off voltage-the on voltage. At this time, considering the entire time when the off voltage is applied, the off duty ratio is about 25%. In addition, considering the entire time when the on voltage is applied, the on duty ratio is about 75%. In the case of the fourth light emission control signal (4 cycles, 25%), the off duty ratio and the light emission cycle increase compared to the first light emission control signal (1 cycle, 0.2%). In the fourth light emission control signal (4 cycles, 25%), the lower luminance may be expressed by increasing the off duty ratio. In addition, by increasing the light emission cycle, it may be seen that the effect of being driven at 240 Hz is achieved by substantially emitting light four times in one frame.

In the case of the fifth light emission control signal (4 cycles 50%), 4 off voltages and 4 on voltages are applied within one frame. It may be applied in sequential order of the off voltage, the on voltage, the off voltage, the on voltage, the off voltage, the on voltage, the off voltage, and the on voltage. In this case, considering the entire time when the off voltage is applied, the off duty ratio is about 50%. In addition, considering the entire time when the on voltage is applied, the on duty ratio is about 50%. In the case of the fifth light emission control signal (4 cycles, 50%), the off duty ratio increases compared to the fourth light emission control signal (4 cycles, 25%), and the light emission cycle is maintained. In the fifth light emission control signal (4 cycles, 50%), lower luminance can be expressed by increasing the off duty ratio. In addition, it may be seen that the effect of being driven at 240 Hz is achieved by substantially emitting light four times in one frame.

In the display device according to an example embodiment, the light emission cycle controller determines the on/off duty ratio and the light emission cycle of the light emission control signal and transmits them to the light emission driver, so that the various light emission control signals may be output.

Hereinafter, an example of determining the off duty ratio of the light emission control signal according to the required luminance of the display device according to an example embodiment is described.

Figure 5:
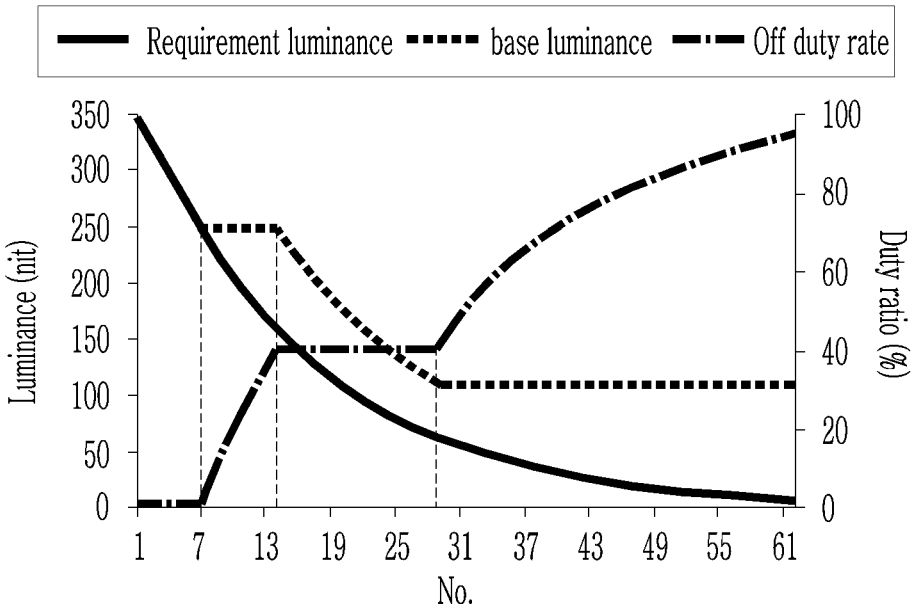
FIG. 5 is a graph of an off duty ratio of a base luminance and a light emission control signal according to a required luminance of a display device according to an example embodiment.

FIG. 5 is a graph showing an off duty ratio of a base luminance and a light emission control signal according to a required luminance of a display device according to an example embodiment.

As shown in FIG. 5, in the case of No. 1 positioned leftmost, the required luminance of the display device according to an example embodiment can be set as about 350 nits. At this time, the required luminance of about 350 nits may be implemented by setting the base luminance to about 350 nits and the off duty ratio of the light emission control signal to about 0%. The required luminance means the luminance that is actually output on the screen, and the base luminance means the maximum luminance that may be expressed by the voltage supplied to the pixel. Even if the voltage according to the same base luminance is supplied, the luminance actually output to the screen may be adjusted by adjusting the off duty ratio.

For the sections from No. 1 to No. 7, the required luminance may be reduced from about 350 nits to about 250 nits. At this time, while maintaining the off duty ratio at about 0%, by reducing the base luminance from about 350 nits to about 250 nits, it is possible to implement the required luminance from about 350 nits to about 250 nits.

In the sections from No. 7 to No. 13, the required luminance may be reduced from about 250 nits to about 150 nits. At this time, while maintaining the base luminance at about 250 nits, by increasing the off duty ratio from about 0% to about 40%, it is possible to implement the required luminance of about 250 nits to about 150 nits.

For the sections from No. 13 to No 30, the required luminance may be reduced from about 150 nits to about 70 nits. At this time, while maintaining the off duty ratio at about 40%, by reducing the base luminance from about 250 nits to about 120 nits, it is possible to implement the required luminance of about 150 nits to about 70 nits.

For the section from No. 30 to No. 61, the required luminance may be reduced from about 70 nits to about 0 nit. At this time, by increasing the off duty ratio from about 40% to about 100% while maintaining the base luminance at about 120 nits, it is possible to implement the required luminance of about 70 nits to about 0 nit.

In the above, the example of the method of adjusting the base luminance and the off duty ratio in order to implement the required luminance has been described, but is not limited thereto. As described above, the required luminance can be implemented by changing the off duty ratio while maintaining the base luminance in some sections, and changing the base luminance while maintaining the off duty ratio in some sections. At this time, the setting of the section may be variously changed. In addition, the values of the base luminance and the off duty ratio to implement the required luminance may be variously changed.

Hereinafter, a complex flicker index according to the driving frequency, the luminance, the off duty ratio, and the light emission cycle is described with reference to FIG. 6, FIG. 7, and FIG. 8.

Figure 6:
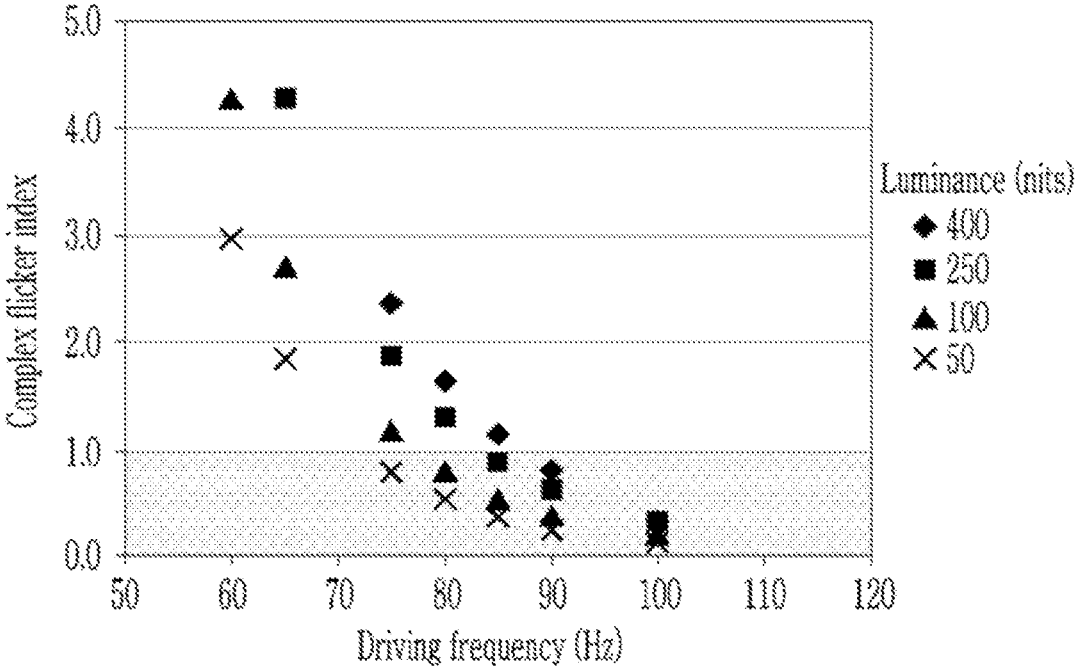
FIG. 6 is a graph showing a complex flicker index according to the driving frequency and luminance.

FIG. 6 is a graph showing a complex flicker index according to the driving frequency and luminance. In FIG. 6, it is fixed that the off duty ratio is 40%, and there is one light emission cycle. FIG. 7 and FIG. 8 are graphs showing a complex flicker index of an off duty ratio and a luminance. In FIG. 7, it is fixed that the driving frequency is 90 Hz, and there is one light emission cycle. In FIG. 8, it is fixed that the driving frequency is 120 Hz, and there is one light emission cycle.

The complex flicker index is a numerical value indicating an occurrence degree of a flicker phenomenon, and is a value reflecting sensitivity to the frequency component after extracting an optical waveform and converting it into a frequency component. The higher the complex flicker index is, the larger the flicker phenomenon may appear. If the complex flicker index is less than 1, the flicker phenomenon is not recognized and may be ignored.

As shown in FIG. 6, in the state that the off duty ratio and the light emission cycle are fixed when the same luminance appears, the complex flicker index tends to decrease as the driving frequency increases. For example, when the luminance is about 50 nits, and if the driving frequency is 75 Hz or more, the complex flicker index is 1 or less. Also, when the luminance is about 100 nits, and if the driving frequency is 80 Hz or more, the complex flicker index is 1 or less. In addition, when the luminance is about 250 nits, and if the driving frequency is 85 Hz or more, the complex flicker index is 1 or less. Further, when the luminance is about 400 nits, and if the driving frequency is 90 Hz or more, the complex flicker index is 1 or less.

In addition, in the state that the off duty ratio and the light emission cycle are fixed, as the luminance decreases at the same driving frequency, the complex flicker index tends to decrease. For example, when the driving frequency is 75 Hz, and if the luminance is about 50 nits or less, the complex flicker index is 1 or less. Also, when the driving frequency is 80 Hz, and if the luminance is about 100 nits or less, the complex flicker index is 1 or less. In addition, when the driving frequency is 85 Hz, and if the luminance is 250 nits or less, the complex flicker index is 1 or less. Further, when the driving frequency is 90 Hz, and if the luminance is about 400 nits or less, the complex flicker index 1 or less. When the driving frequency is 90 Hz or more, the complex flicker index may be 1 or less regardless of the luminance.

Figure 7:
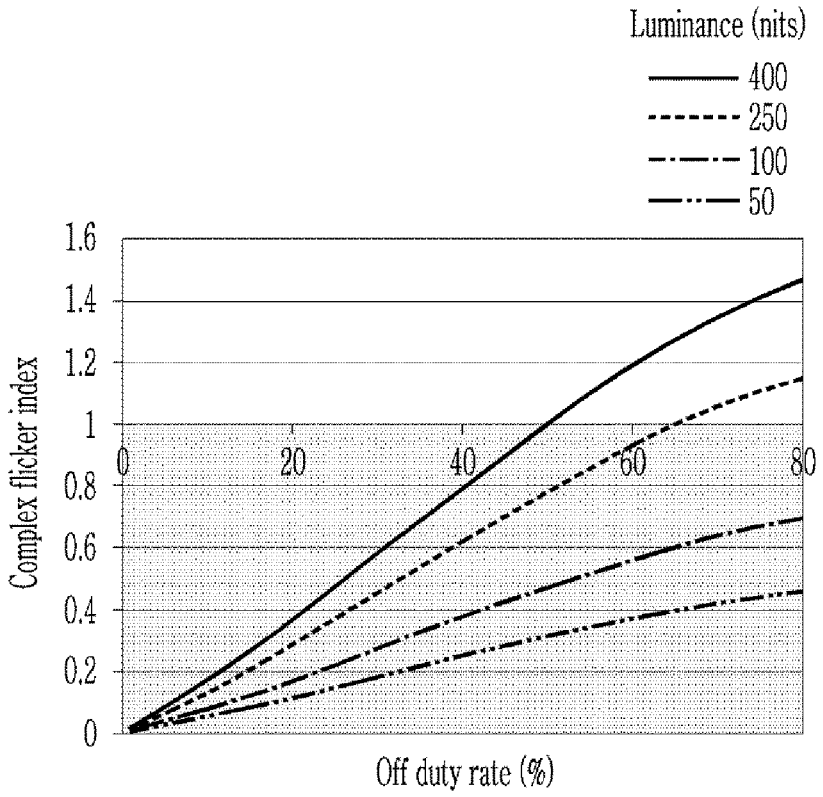
FIG. 7 and FIG. 8 are graphs showing a complex flicker index of an off duty ratio and a luminance.

As shown in FIG. 7, in the state that the driving frequency and the light emission cycle are fixed, when the same luminance appears, the complex flicker index tends to decrease as the off duty ratio decreases. For example, when the luminance is about 400 nits, and if the off duty ratio is about 50% or less, the complex flicker index is 1 or less. In addition, when the luminance is about 200 nits, and if the off duty ratio is about 65% or less, the complex flicker index is 1 or less. Further, when luminance is about 100 nits or less, the complex flicker index may be 1 or less regardless of the off duty ratio.

In addition, in the state that the driving frequency and the light emission cycle are fixed, when the same off duty ratio is obtained, the complex flicker index tends to decrease as the luminance decreases. For example, when the off duty ratio is about 80%, and if the luminance is about 100 nits or less, the complex flicker index is 1 or less. In addition, when the off duty ratio is about 60%, and if the luminance is about 200 nits or less, the complex flicker index is 1 or less. Further, when the off duty ratio is less than about 40%, the complex flicker index may be 1 or less regardless of luminance.

Figure 8:
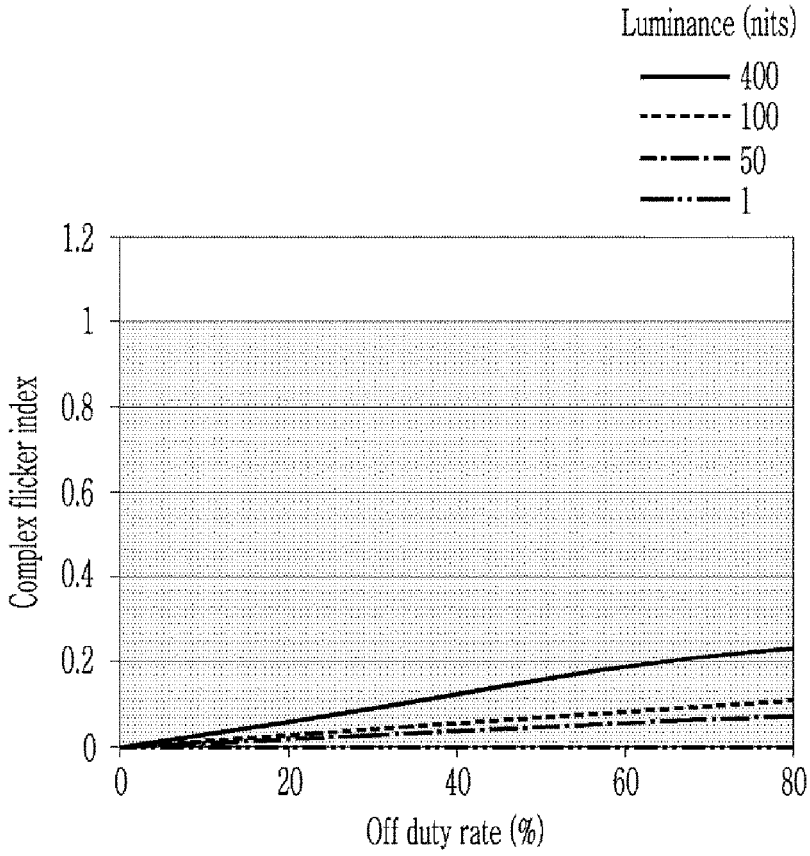

As shown in FIG. 8, in the state that the driving frequency and the light emission cycle are fixed, when the same luminance appears, the complex flicker index tends to decrease as the off duty ratio decreases. In addition, in the state that the driving frequency and the light emission cycle are fixed, when the same off duty ratio is obtained, the complex flicker index tends to decrease as the luminance decreases. FIG. 8 is the case that the driving frequency is 120 Hz, the complex flicker index varies depending on the off duty ratio and the luminance, but all were found to be 1 or less. Therefore, when the driving frequency is 120 Hz, it may be seen that the flicker is not visually recognized.

According to the graph analysis in FIG. 6, FIG. 7, and FIG. 8, when the complex flicker index is 1 or less, there may be one light emission cycle as the flicker phenomenon is not visually recognized. In addition, when the complex flicker index is 1 or more, there may be two or more light emission cycles as the flicker phenomenon is visually recognized. For example, when the driving frequency is 120 Hz, the complex flicker index is 1 or less regardless of the luminance and the off duty ratio, so the light emission cycle may be performed once. Even when the driving frequency is 100 Hz, since the complex flicker index is 1 or less regardless of the luminance and the off duty ratio, the light emission cycle may be performed once. When the driving frequency is 90 Hz, the complex flicker index is 1 or less regardless of the off duty ratio at low luminance of 100 nits or less, so the light emission cycle may be performed once. When the driving frequency is 90 Hz, at a high luminance of 250 nits or higher, in the case that the off duty ratio is low, since the complex flicker index is 1 or less, there may be one light emission cycle, and when the off duty ratio is high, since the complex flicker index is 1 or more, there may be two or more emission cycles. When the driving frequency is 90 Hz and the luminance is 400 nits, and if the off duty ratio is 50% or less, there may be one light emission cycle, and if the off duty ratio exceeds 50%, there may be six light emission cycles.

Considering the number of such various cases, the number of the light emission cycles in which the complex flicker index may be 1 or less according to the driving frequency, the required luminance and the off duty ratio may be configured as a look-up table (LUT). That is, if the information for the driving frequency, the required luminance, and the off duty ratio is input, the number of light emission cycles may be determined. Accordingly, the information of the determined light emission cycle is transmitted to the light emission driver together with the information of the off duty ratio, thereby outputting the light emission control signal.

Hereinafter, the driving method of the display device according to an example embodiment is described with reference to FIG. 9.

Figure 9:
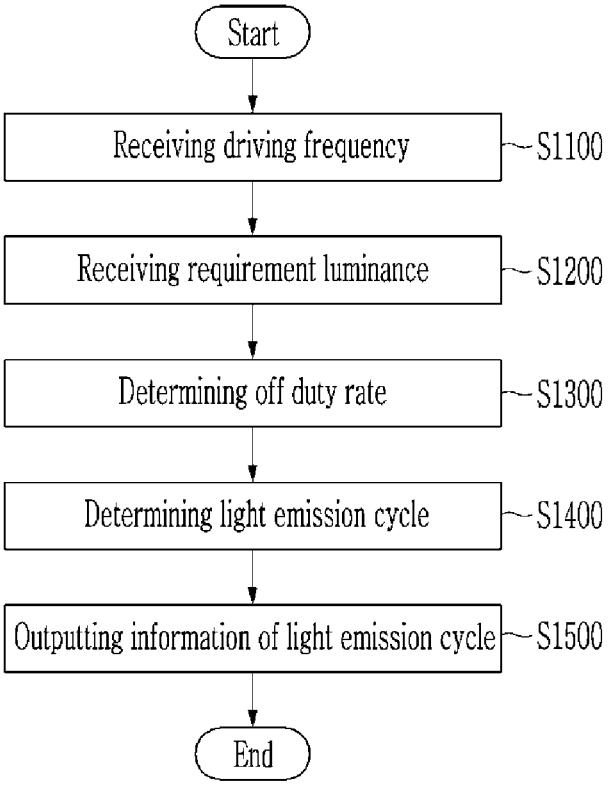
FIG. 9 is a flowchart showing a driving method of a display device according to an example embodiment.

FIG. 9 is a flowchart showing a driving method of a display device according to an example embodiment.

As shown in FIG. 9, first, at a step of S1100, the display device according to an example embodiment receives the driving frequency. The driving frequency receiving unit of the light emission cycle controller of the display device according to an example embodiment may receive the driving frequency of the display device. For example, the driving frequency may be 60 Hz, 90 Hz, or 120 Hz.

Next, at a step of S1200, the required luminance receiving unit of the light emission cycle controller may receive the required luminance. For example, the required luminance may be about 400 nits, 250 nits, 100 nits, or 50 nits, etc.

At a step of S1300, the duty ratio determining unit of the light emission cycle controller may receive the information for the required luminance to determine the off duty ratio of the light emission control signal. For example, the off duty ratio may be about 0%, 20%, 40%, 60%, or 80%, etc. When the required luminance is 400 nits, the off duty ratio may be about 0%, and when the required luminance is 150 nits, the off duty ratio may be about 40%. The lower the required luminance is, the higher the off duty ratio may be set. However, this is only an example, and the value of the off duty ratio according to the required luminance may be variously changed. The required luminance may be implemented by adjusting the base luminance and the off duty ratio. In particular, it is advantageous to implement the required luminance by increasing the off duty ratio in the low luminance range.

At a step of S1400, the light emission cycle determining unit of the light emission cycle controller may receive the information for the driving frequency, the required luminance, and the off duty ratio of the light emission control signal to determine the light emission cycle. For example, when the driving frequency is 120 Hz, there may be one light emission cycle regardless of the required luminance and the off duty ratio. When the driving frequency is 90 Hz, the required luminance is 400 nits, and the off duty ratio is 0%, there may be one light emission cycle. When the driving frequency is 90 Hz, the required luminance is 400 nits, and the off duty ratio is 60%, there may be six light emission cycles.

At a step of S1500, the light emission cycle controller may output the information for the determined light emission cycle. The light emission cycle controller may transmit the information for the determined light emission cycle and off duty ratio to the light emission driver. The light emission driver may output the light emission control signal according to the transmitted information to the pixel unit.

Hereinafter, the step of determining the light emission cycle (S1400) is further described with reference to FIG. 10 as follows.

Figure 10:
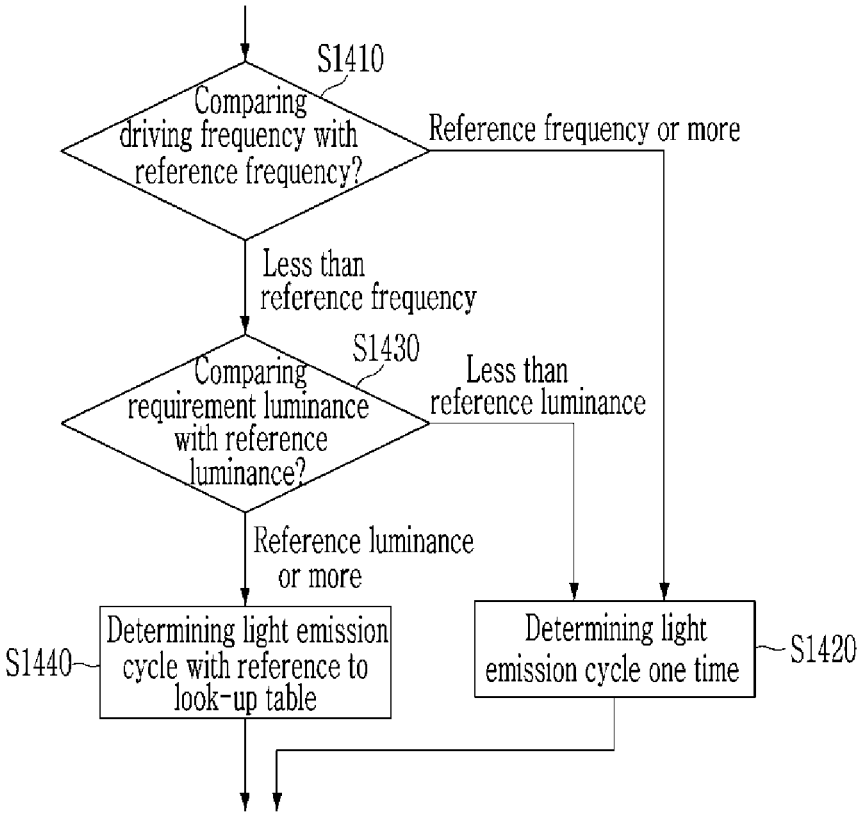
FIG. 10 is a flowchart showing some steps of a driving method of a display device according to an example embodiment.

FIG. 10 is a flowchart showing steps of a driving method of a display device according to an example embodiment. FIG. 10 shows the steps to determine the light emission cycle.

As shown in FIG. 10, at a step of S1410, the light emission cycle determining unit of the light emission cycle controller compares the driving frequency with the reference frequency. At a step of 1420, when the driving frequency is greater than or equal to the reference frequency, the number of light emission cycles may be determined to be one. For example, when the driving frequency is 100 Hz or more, since the flicker is not visually recognized regardless of the required luminance and off duty ratio, there may be one light emission cycle. That is, when the reference frequency is determined to be 100 Hz and the driving frequency is 100 Hz or more, there may be one light emission cycle regardless of the information for the required luminance and the off duty ratio. If the driving frequency is less than 100 Hz, the next step may be performed. In this case, the reference frequency has been described as 100 Hz, however this is only an example, and the reference frequency may be variously changed.

Then, at a step of S1430, the required luminance is compared with the reference luminance. When the required luminance is less than the reference luminance, the number of light emission cycles may be determined to be one which is shown at a step of S1420. At this time, the reference luminance may be changed according to the driving frequency. For example, when the driving frequency is 90 Hz, the reference luminance may be 150 nits. When the driving frequency is 90 Hz and the required luminance is less than 150 nits, the number of light emission cycles may be determined to be one. When the driving frequency is 90 Hz and the required luminance is 150 nits or more, the next step may be performed. At this time, when the driving frequency is 90 Hz, the reference luminance is described as 150 nits, but this is only an example, and the reference luminance can be variously changed. Also, the reference luminance per each driving frequency may be variously set.

Next, at a step of S1440, when the driving frequency is less than the reference frequency, and the required luminance is the reference luminance or more, the number of light emission cycles may be determined with reference to the look-up table (LUT). The look-up table (LUT) may include information for a minimum light emission cycle in which the complex flicker index is less than 1 according to the driving frequency, the required luminance, and the off duty ratio. That is, the information for the minimum light emission cycle that may prevent the flicker from being visually recognized may be derived through the look-up table (LUT).

The information for the light derived emission cycle may be output through this process.

According to the driving method of the display device according to an example embodiment, the number of light emission cycles of the light emission control signal may be selectively adjusted without being fixed. In the driving method of the display device according to an example embodiment, when the flicker is not expected to be visually recognized, the number of light emission cycles is determined and driven to be one, and when the flicker is expected to be visually recognized, the number of light emission cycles may be determined and driven to be two or more. As described above, by selectively controlling and driving the light emission cycles of the light emission control signal, it is possible to prevent the occurrence of the flicker compared to the case where the light emission cycle is fixed as one time to be driven. In addition, by selectively controlling and driving the light emission cycles of the light emission control signal, the occurrence of the stepped blur may be minimized and the driving voltage may be reduced compared to the case where the number of light emission cycles is fixed as several times to be driven, for example, six times.

While this disclosure has been described in connection with what is presently considered to be practical example embodiments, it is to be understood that the disclosure is not limited to the disclosed embodiments. On the contrary, it is intended to cover various modifications and equivalent arrangements included within the spirit and scope of the appended claims.

What is claimed is:

1. A display device comprising:

a pixel unit including a plurality of pixels;

a light emission driver outputting a light emission control signal having different light emission cycles according to a driving frequency and a required luminance to the pixel unit, and a light emission cycle controller including a driving frequency receiving unit for receiving the driving frequency, a required luminance receiving unit for receiving the required luminance, a duty ratio determining unit for determining an off duty ratio of the light emission control signal, and a light emission cycle determining unit for determining the light emission cycle, wherein the light emission cycle determining unit derives the light emission cycle by using a look-up table, the look-up table includes information for a minimum light emission cycle in which a complex flicker index is less than 1 according to the driving frequency, the required luminance, and the off duty ratio, the complex flicker index is a numerical value indicating an occurrence degree of a flicker phenomenon, and is a value reflecting sensitivity to the frequency component after extracting an optical waveform and converting it into a frequency component, when the driving frequency and the light emission cycle are fixed, and when a same the required luminance appears, the complex flicker index decreases as the off duty ratio decreases, and when the driving frequency is 90 Hz and the required luminance is 400 nits or more, if the off duty ratio is 50% or less, there is one light emission cycle, and if the off duty ratio is more than 50%, there are six light emission cycles.

2. The display device of claim 1, wherein the light emission cycle controller is configured to receive the driving frequency and the required luminance to determine an on/off duty ratio and the light emission cycle of the light emission control signal to be output to the light emission driver.

3. The display device of claim 2, wherein the duty ratio determining unit sets the off duty ratio higher as the required luminance is lower.

4. The display device of claim 2, wherein the light emission cycle determining unit determines the light emission cycle from the driving frequency, the required luminance, and the off duty ratio.

5. The display device of claim 4, wherein when the driving frequency is 90 Hz, if the required luminance is less than 150 nits, there is one light emission cycle, and if the required luminance is 150 nits or more, there is more than one light emission cycle.

6. The display device of claim 4, wherein when the driving frequency is 100 Hz or more, there is one light emission cycle.

7. The display device of claim 4, wherein the pixel unit includes a plurality of scan lines, a plurality of data lines, and a plurality of light emission control lines connected to each of the plurality of pixels, and the light emission control line transmits the light emission control signal from the light emission driver to the pixel unit.

8. A driving method of a display device comprising steps of:

receiving a driving frequency of a display device;

receiving a required luminance representing a brightness of a screen of the display device;

determining a light emission cycle of a light emission control signal output to the pixel unit according to the driving frequency and the required luminance, and determining an off duty ratio of the light emission control signal according to the required luminance, wherein the determining the light emission cycle of the light emission control signal is accomplished by comparing the driving frequency with a reference frequency, comparing the required luminance with a reference luminance, and determining the light emission cycle, wherein the determining the light emission cycle derives the light emission cycle by using a look-up table, the look-up table includes information for a minimum light emission cycle in which a complex flicker index is less than 1 according to the driving frequency, the required luminance, and the off duty ratio, the complex flicker index is a numerical value indicating an occurrence degree of a flicker phenomenon, and is a value reflecting sensitivity to the frequency component after extracting an optical waveform and converting it into a frequency component, when the driving frequency and the light emission cycle are fixed, and when a same the required luminance appears, the complex flicker index decreases as the off duty ratio decreases, and when the driving frequency is 90 Hz and the required luminance is 400 nits or more, if the off duty ratio is 50% or less, there is one light emission cycle, and if the off duty ratio is more than 50%, there are six light emission cycles.

9. The driving method of claim 8, wherein in the determining the off duty ratio of the light emission control signal, the lower the required luminance is, the higher the off duty ratio is.

10. The driving method of claim 9, wherein in the determining the light emission cycle of the light emission control signal, the light emission cycle is determined by the driving frequency, the required luminance, and the off duty ratio.

11. The driving method of claim 10, wherein when the driving frequency is compared with the reference frequency and the driving frequency is the reference frequency or more, there is one light emission cycle.

12. The driving method of claim 11, wherein the reference frequency is 100 Hz.

13. The driving method of claim 10, wherein when the required luminance is compared with the reference luminance and the required luminance is less than the reference luminance, there is one light emission cycle.

14. The driving method of claim 13, wherein the reference luminance has different values according to the driving frequency.

* * * * *